United States Patent [19]

Sappok

[11] Patent Number: 4,882,092

[45] **Date of Patent: * Nov. 21, 1989**

[54] METHOD OF MAKING RADIATION SHIELDING ELEMENTS FOR USE IN NUCLEAR TECHNOLOGY

[75] Inventor: Manfred Sappok, Tonisvorst, Fed. Rep. of Germany

[73] Assignee: Siempelkamp Giesserei GmbH & Co., Krefeld, Fed. Rep. of Germany

[ * ] Notice: The portion of the term of this patent subsequent to Aug. 30, 2005 has been disclaimed.

[21] Appl. No.: 202,793

[22] Filed: Jun. 3, 1988

Related U.S. Application Data

[63] Continuation-in-part of Ser. No. 113,338, Oct. 22, 1987, Pat. No. 4,767,572, which is a continuation of Ser. No. 840,423, Mar. 17, 1986, abandoned.

[30] Foreign Application Priority Data

Jul. 13, 1985 [DE] Fed. Rep. of Germany ..... 3527319

[51] Int. Cl.[4] ..... G21F 9/16; G21F 5/00; G21C 19/00; G21C 9/00

[52] U.S. Cl. ..... 252/628; 250/506.1; 250/515.1; 250/518.1; 252/629; 252/633; 252/478; 376/272; 376/287; 376/288

[58] Field of Search ..... 252/628, 629, 633, 478; 250/506.1, 515.1, 518.1; 376/260, 261, 272, 287; 405/128, 129

[56] References Cited

U.S. PATENT DOCUMENTS

| | | | |
|---|---|---|---|
| 3,865,734 | 2/1975 | Woodbridge | 378/67 |
| 4,337,167 | 6/1982 | Bird et al. | 250/506.1 |
| 4,430,256 | 2/1984 | Rustum | 252/628 |
| 4,437,013 | 3/1984 | Hondorp | 250/515.1 |
| 4,451,739 | 5/1984 | Christ et al. | 250/506.1 |
| 4,474,689 | 10/1984 | Bird et al. | 252/633 |
| 4,533,395 | 8/1985 | Vejmelka et al. | 106/89 |

*Primary Examiner*—Howard J. Locker
*Attorney, Agent, or Firm*—Herbert Dubno

[57] ABSTRACT

Nuclear residues with a Co60 specific activity of 1 to 100 Bq/g, such as concrete or metal parts of a nuclear reactor installation, are used as raw materials for the production of radiation shielding structures for such nuclear installation. The concrete reisdues can be broken up to form an aggregate for concrete which is cast to form such structures and metal objects can be added for the casting of transport and storage vessels for radioactive wastes.

12 Claims, No Drawings

METHOD OF MAKING RADIATION SHIELDING ELEMENTS FOR USE IN NUCLEAR TECHNOLOGY

CROSS REFERENCE TO RELATED APPLICATIONS

This application is a continuation-in-part of Ser. No. 113,338 filed 22 Oct. 1987 (now U.S. Pat. No. 4,767,572), which is a continuation of Ser. No. 840,423 filed 17 Mar. 1986, now abandoned.

FIELD OF THE INVENTION

My present invention relates to a method of making radiation shielding structures for use in nuclear technology and, more specifically, for use in nuclear reactor installations, e.g. nuclear power plants, or in other installations in which radioactive wastes arise. The invention also relates to the structures made by this process.

BACKGROUND OF THE INVENTION

The use of radiation shielding structures in nuclear technology is, of course, widespread. Such structures are generally fabricated from metal or concrete, utilizing virgin materials, and are designed to provide a relatively high neutron cross section to minimize the transmission of radiation from a space enclosed by the structures to the environment or to so reduce the energy of that radiation which is transmitted as to render it harmless.

Radiation shielding structures can include housings for radioactive chambers including the core of a nuclear reactor, containment vessels which may be provided outwardly of the core or highly radioactive portions of the installation to serve as a housing, pipes through which radioactive fluids can pass, and even containers which may be used for the temporary or permanent storage or disposal of radioactive wastes.

In nuclear installations of the aforedescribed type, moreover, radioactive wastes are generated in operation or are created by the removal of radioactive parts of the structure as part of maintenance or replacement procedures. The term "radioactive waste" as used herein, therefore, should be understood to include not only the radioactive materials produced by the operation of an installation apart from the fuel products which are generally recovered, but also the piping, wall structure, machinery and like elements which have in the past created a disposal problem when replacement was required.

Disposal of such materials has posed a very significant problem since disposal sites and techniques for the safe disposal of radioactive storages are limited and costly. Indeed, the magnitude of the wastes has been a major factor in the decreased introduction of nuclear power in many parts of the world.

OBJECTS OF THE INVENTION

It is the principal object of the present invention to provide an improved method of making radiation-shielding structures whereby at least some of the aforementioned disadvantages will be obviated.

Another object of this invention is to reduce the amount of radioactive materials which have to be disposed of by expensive radiation waste disposal technology.

Still another object of the invention is to provide improved radiation-shielding structures which contribute to the overall economy of nuclear installations.

It is also an object of the invention to advance the principles of the above-mentioned applications.

DESCRIPTION OF THE INVENTION

I have discovered, surprisingly, that it is possible to utilize radioactive residues, especially in the form of removed structures of a nuclear installation, as constituent substances in the formation of radiation shielding structures which can be used in the same or similar installation. This is indeed surprising because the substances derived from nuclear power plant installations are radioactive and one would normally expect that the last thing which could be tolerated in a shielding material is a substance which itself is radioactive. However, I have found that in practice when such substances are incorporated as aggregates in concrete or in smelted form as metals which are incorporated in cast shielding structures, there is practically no detrimental contribution of radiation to the environment from such substances provided that the cobalt 60 equivalent specific activity lies below 100 Bq/g (of the substance before introduction into the concrete or metal structure which is formed therefrom). The lower limit of the Co60 equivalent specific activity contemplated in this invention is 1 Bq/g. This is some two orders of magnitude higher than natural activity levels which is about 0.01 Bq/g.

According to a feature of the invention, the radioactive objects are comminuted and utilized as an aggregate to concrete which is formed into the shielding structures. The radioactive objects can themselves be concrete which is broken up for use as the aggregate, or comminuted metals or a combination of the two.

According to a feature of the invention, however, when the radioactive objects are metal, they are smelted together, with other metals and used to produce cast alloys which are cast into the shielding structures, especially shielding transport and/or storage vessels as described in one or more of the following U.S. Pat.:

| | |
|---|---|
| 4,229,316 | 21 October 1980 |
| 4,235,739 | 25 November 1980 |
| 4,234,798 | 18 November 1980 |
| 4,278,892 | 14 July 1981 |
| 4,447,733 | 8 May 1984 |

Of course it is possible to control the activity of the resulting product by the choice of alloying elements used or the composition of the alloy formed. It has been found, surprisingly, that radioactive substances added to a cast structure under the conditions set forth above improve the neutron-capture capabilities of the structure.

The smelting and casting can be effected, in spite of the radioactivity of the nuclear plant residues which are employed, utilizing known technology as described, for example, in German Pat. documents DE 33 31 383,.DE 34 04 106 and DE 34 40 277.

As a consequence of the invention, radioactive residues, especially metal and concrete parts of nuclear installations, need not be subject to expensive disposal practices, but rather can be incorporated without difficulty in new shielding structures which remain in a nuclear installation environment as long as the radioactive residues have a cobalt 60 equivalent specific activity between 1 and 100 Bq/g. In effect, therefore, such materials are recycled to a radiation shielding use and to a corresponding extent the increase in radioactive waste is abated.

EXAMPLE 1

Stainless steel piping from a nuclear power plant, contaminated to the extent that it has a cobalt 60 equivalent specific activity of about 80 Bq/g is smelted together with a cast iron of the type usually used for the production of transport vessels in accordance with the aforementioned U.S. patents, in an amount of 25% by weight of the radioactive residue and 75% of the customary cast iron composition.

Transport and storage vessels, as described in the aforementioned U.S. patents, are then cast from the resulting melt.

The radiation added to the environment as a result of the residue incorporated in the container structure is minimal and the container structure is found to have a greater shielding capacity for radiation than a virgin cast iron without the radioactive residue.

EXAMPLE 2

A concrete containment vessel for a nuclear power plant reactor is broken up into gravel-size particles by crushing and used as a aggregate in place of an equivalent amount of gravel in concrete which is then placed to form a radiation shielding wall. Here again the contribution of radiation to the environment is minimal when the radioactive aggregate has a cobalt 60 specific activity of 50 Bq/g.

I claim:

1. A method of making a radiation shielding structure for a nuclear installation which comprises the steps of:

(a) deriving a radioactive residue having a cobalt 60 equivalent specific activity below 100 Bq/g from parts of a former nuclear reactor installation;

(b) incorporating said radioactive residue in a composition; and (c) forming said composition into a radiation shielding solid structure.

2. The method defined in claim 1 wherein said residue is derived from concrete parts of said installation.

3. The method defined in claim 2 wherein said residue is derived from metal parts of said installation.

4. The method defined in claim 1 wherein said residue is comminuted and incorporated into a concrete composition as an aggregate.

5. The method defined in claim 1 wherein said residue is smelted in the formation of said composition to form a casting melt.

6. The method defined in claim 5 wherein said casting melt is cast to form a transport and storage vessel constituting the radiation shielding structure.

7. The method defined in claim 6 wherein additional alloying elements are added to said residue in the formation of said melt.

8. A radiation shielding structure made by the method defined in claim 1.

9. The use of a radioactive nuclear plant residue having a cobalt 60 equivalent specific activity below 100 Bq/g as a material for the production of radiation shielding structures.

10. A method for the use of comminuted radioactive concrete, having previously been a building component for a nuclear installation, as a construction material in a new concrete radiation shielding structure, said comminuted concrete having a cobalt 60 equivalent specific activity below 100 Bq/g.

11. A method for the use of contaminated metal parts, previously having been a structural component of a nuclear installation, as a part of a new radiation shielding structure in the form of a transport and storage vessel, said radioactive metal parts having a cobalt 60 equivalent specific activity below 100 Bq/g.

12. The method defined in claim 1 wherein said cobalt 60 equivalent specific activity ranges from 1 to below 100 Bq/g.

* * * * *